US006909379B2

(12) United States Patent
Niizato

(10) Patent No.: US 6,909,379 B2
(45) Date of Patent: Jun. 21, 2005

(54) WIRELESS REMOTE CONTROLLER, WIRELESS REMOTE CONTROL METHOD, AND AIR CONDITIONER USING THE SAME

(75) Inventor: Atsushi Niizato, Tochigi (JP)

(73) Assignees: Sanyo Electric Co., Ltd., Osaka (JP); Sanyo Electric Air Conditioning Co., Ltd., Tochigi (JP)

( * ) Notice: Subject to any disclaimer, the term of this patent is extended or adjusted under 35 U.S.C. 154(b) by 413 days.

(21) Appl. No.: 10/120,973

(22) Filed: Apr. 10, 2002

(65) Prior Publication Data

US 2002/0154026 A1 Oct. 24, 2002

(30) Foreign Application Priority Data

Apr. 24, 2001 (JP) ..... 2001-126302

(51) Int. Cl.[7] ..... G08C 19/00
(52) U.S. Cl. ..... 340/825.72; 359/142; 341/176
(58) Field of Search ..... 340/825.72; 315/149; 341/173, 176; 307/116; 359/172, 159, 176, 142

(56) References Cited

U.S. PATENT DOCUMENTS 4,769,643 A * 9/1988 Sogame ..... 340/825.69
5,554,979 A * 9/1996 Kohar et al. ..... 340/825.72
5,905,442 A * 5/1999 Mosebrook et al. ..... 340/3.7
6,149,513 A * 11/2000 Lyu ..... 454/152

* cited by examiner

*Primary Examiner*—Michael Horabik
*Assistant Examiner*—M Shimizu
(74) *Attorney, Agent, or Firm*—Darby & Darby

(57) ABSTRACT

In a wireless remote controller for transmitting a control signal to each of plural control target units to control the operation of each of the control target unit, the power of the control signal to be transmitted to a desired one of the control target units is varied (lowered) in accordance with an operation which is expected to be executed by the desired control target unit. The wireless remote controller and the control target unit are associated with each other in an address connected relationship, and only when a control signal for casing the control target unit to perform a specific operation other than normal operations is transmitted to the control target unit, the address connected relationship is set to an address-free state, and the power of the control signal is varied (lowered) so that the control signal affects only the control target unit.

14 Claims, 4 Drawing Sheets

WIRELESS REMOTE CONTROLLER, WIRELESS REMOTE CONTROL METHOD, AND AIR CONDITIONER USING THE SAME

BACKGROUND OF THE INVENTION

1. Field of the Invention

The present invention relates to a wireless remote controller for transmitting a control signal to control target equipment to operate the control target equipment, a wireless remote control method and an air conditioner having an indoor unit which can be remotely operated on the basis of a control signal transmitted from a wireless remote controller.

2. Description of the Related Art

Various types of air conditioners have been known and practically used, and as one of these air conditioners is known a ceiling embedded type air conditioner in which an indoor unit is set up in a room of a building while embedded in the ceiling of the room.

There are practically used some ceiling embedded type air conditioners in which not only fundamental operations such as the start/stop operation of the indoor units, etc., but also the elevating (upwardly/downwardly moving) operation of grilles of the indoor units are carried out on the basis of control signals transmitted from a single wireless remote controller or plural wireless remote controllers.

The grille of the indoor unit is mounted at the front side of the indoor unit, and is provided with an air suction port through which room air is sucked into the indoor unit. Further, a filter for filtering the sucked room air to remove dust, etc. is further mounted on the grille so as to confront the air suction port. Accordingly, when the filter is cleaned or exchanged by a new one, the grille is downwardly moved by using a wireless remote controller.

FIG. 1 shows an air conditioner having plural indoor units 101A, 101B, 101C which are mounted in the same room and operated by using corresponding wireless remote controllers 102A, 102B, 102C, respectively. That is, the indoor units 101A, 101B, 101C and the wireless remote controllers 102A, 102B, 102C are connected with one another in one-to-one correspondence. Particularly, FIG. 1 shows a case where a fundamental (normal) operation is carried out on the basis of a control signal transmitted from the wireless remote controller 102A.

In general, the same address is set to each indoor unit 101A (101B, 101C) and the corresponding wireless remote controller 102A (102B, 102C). Therefore, only when the address is coincident between the indoor unit 101A, 101B, 101C and the wireless remote controller 102A, 102B, 102C, the indoor unit 101A, 101B, 101C accepts the control signals from the wireless remote controller 102A, 102B, 102C. This is because an indoor unit (101A, 101B, 101C) which is not expected to be operated is carelessly operated on the basis of a control signal from a wireless remote controller (102A, 102B, 102C) which is not connected to the indoor unit.

In the case of FIG. 1, the control signal transmitted from the wireless remote controller 102A is addressed to the indoor unit 101A, and the indoor unit 101A accepts the control signal from the wireless remote controller 102A because the address contained in the control signal is coincident with the address registered therein. However, the indoor units 101B and 101C do not accept the control signal from the wireless remote controller 101A because the address of the control signal is not coincident with the addresses registered therein.

The one-to-one control operation of the indoor units 101A, 101B, 101C by the wireless remote controllers 102A, 102B, 102C as described above (hereinafter referred to as "one-to-one control operation") is applied to not only the fundamental (normal) operations such as the start/stop operation, etc. of the indoor units 101A, 101B, 101C, but also the elevating operation of grilles 103A, 103B, 103C of the indoor units 101A, 101B, 101C.

FIG. 2 shows a case where the grille elevating operation of the indoor unit 101A is carried out on the basis of a control signal from the wireless remote controller 101A.

In this case, in order to move any one of the grilles 103A, 103B, 103C of the indoor units 101A, 101B, 101C upwardly/downwardly, the corresponding wireless remote controller whose address is coincident with the address of the indoor unit of the grille to be upwardly/downwardly moved (hereinafter referred to as "control target unit") must be used, and the remote control operation is more cumbersome. Furthermore, as the number of indoor units is increased, the number of wireless remote controllers is also increased in proportion to the increase of the number of the indoor units. Therefore, it needs some labor to find out the wireless remote controller corresponding to the control target unit even when the grille elevating operation which is a simple operation common to all the indoor units is carried out.

In place of the one-to-one operation for the grille elevating operation as described above may be considered a method of controlling the grille elevating operation of all the indoor units by using a single wireless remote controller. In this case, the control signal for elevating each of the grilles 103A, 103B, 103C must be successively transmitted to each of the indoor units 101A, 101B, 101C while the address set in the single wireless remote controller (for example, wireless remote controller 102A) is successively changed. However, in this case, it is required to successively change and set the address of the wireless remote controller 102*a*, and thus the operation of the indoor units 101A, 101B, 101C is more cumbersome.

Besides, it may be considered that the address connecting relationship between each of the indoor units and each of the wireless remote controllers is released (i.e., the connecting relationship is set to an address-free state) only when the grille elevating operation is carried out on each of the indoor units as shown in FIG. 3. However, in this case, there may occur such an unintentional case that the control signal emitted from the wireless remote controller 102A which is addressed to the indoor unit 101B is transmitted to not only the addressed indoor unit 101B, but also non-addressed indoor units 101A and 101C, so that not only the grille 103B of the indoor unit 101B which is expected to be elevated, but also the grille 103A of the indoor unit 101A and the grille 103C of the indoor unit 101C which are not expected to be elevated are elevated (upwardly or downwardly) because the indoor units 101A, 101B and 101C have excellent receiver sensitivity.

SUMMARY OF THE INVENTION

An object of the present invention is to provide a wireless remote controller which can enhance the operationality of the remote control of plural control target units.

Another object of the present invention is to provide an air conditioner having plural indoor units which can be enhanced in remote control operationality by a wireless remote controller.

In order to attain the above objects, according to the present invention, there is provided a wireless remote controller for transmitting a control signal to control target equipment to control the operation of the control target equipment which is characterized in that the power of the control signal to be transmitted to the control target equipment is varied in accordance with an operation which is expected to be executed by the control target equipment.

In the wireless remote controller, the power of the control signal to be transmitted to the control target equipment is lowered only when the control signal to be transmitted to the control target equipment is a specific control signal for making the control target equipment carry out a specific operation other than normal operations.

In the wireless remote controller, the wireless remote controller and the control target equipment are associated with each other in address-connecting relationship, and only when a control signal for making the control target equipment carry out a specific operation other than normal operations is transmitted to the control target equipment, the address-connecting relationship is set to an address free state, and the power of the control signal is varied.

In the wireless remote controller, the power of the control signal is lowered.

In the wireless remote controller, the control target equipment comprises at least two control target units, and the power of the control signal is lowered to the extent that the control signal reach one of the control target units which is expected to carry out the specific operation, but does not reach the other control target unit which is unexpected to carry out the specific operation.

In the wireless remote controller, the wireless remote controller comprises a control signal generator for generating the control signal in accordance with an operation to be executed by the control target equipment and transmitting the control signal thus generated to the control target equipment, and a controller for varying the power of the control signal to be generated by the control signal generator in accordance with an operation which is expected to be carried out by the control target equipment.

In the wireless remote controller, the control signal generator generates the control signal by making current flow therethrough, and the output power of the control signal is varied by varying the intensity of the current flowing the control signal generator.

In the wireless remote controller, the control signal generator includes a power source, a transmission LED, a first resistor, a first transistor and a second transistor which are connected in this order in series, and further includes a second resistor which is connected to the second transistor in parallel, and the power of the control signal is varied by turning on/off the second transistor.

In the wireless remote controller, the controller outputs a turn-on/off signal to the base of each of the first and second transistors to thereby turn on/off the first and second transistors.

According to the present invention, there is provided an air conditioner having at least two indoor units and at least one wireless remote controller, each of the indoor units being controlled on the basis of a control signal from the wireless remote controller, which is characterized in that the power of the control signal to be transmitted to one of the indoor units is varied in accordance with an operation which is expected to be executed by the indoor unit.

In the air conditioner, the power of the control signal to be transmitted to each of the indoor units is lowered only when the control signal to be transmitted to the indoor unit is a specific control signal for making the indoor unit carry out a specific operation other than normal operations.

In the air conditioner, the wireless remote controller and each of the indoor unit are associated with each other in address-connecting relationship, and only when a control signal for making one of the indoor units carry out a specific operation other than normal operations is transmitted to the one indoor unit, the address-connecting relationship is set to an address-free state, and the power of the control signal is varied.

In the air conditioner, the specific operation is an operation of upwardly and downwardly moving a grille of each indoor unit.

In the air conditioner, the power of the control signal is lowered.

In the air conditioner, the power of the control signal is lowered to the extent that the control signal reach one of the indoor units which is expected to carry out the specific operation, but does not reach the other indoor unit which is unexpected to carry out the specific operation.

In the air conditioner, the wireless remote controller comprises a control signal generator for generating the control signal in accordance with an operation to be executed by each indoor unit and transmitting the control signal thus generated to each indoor unit, and a controller for varying the power of the control signal to be generated by the control signal generator in accordance with an operation which is expected to be carried out by one of the indoor units.

According to the present invention, there is provided a remote control method of transmitting a control signal from at least one wireless remote controller to each of plural control target units and controlling the operation of one or more of the control target units on the basis of the control signal thus transmitted, which is characterized by comprising the steps of associating the wireless remote controller and each of the control target units in address-connecting relationship, and varying the power of the control signal to be transmitted to a desired one of the control target units only when the control signal to be transmitted to the control target unit concerned is a specific control signal for making the control target unit concerned carry out a specific operation other than normal operations so that the control signal reaches only the desired one of the control target units.

DETAILED DESCRIPTION OF THE DRAWINGS

Preferred embodiments according to the present invention will be described hereunder with reference to the accompanying drawings.

Figure 4:
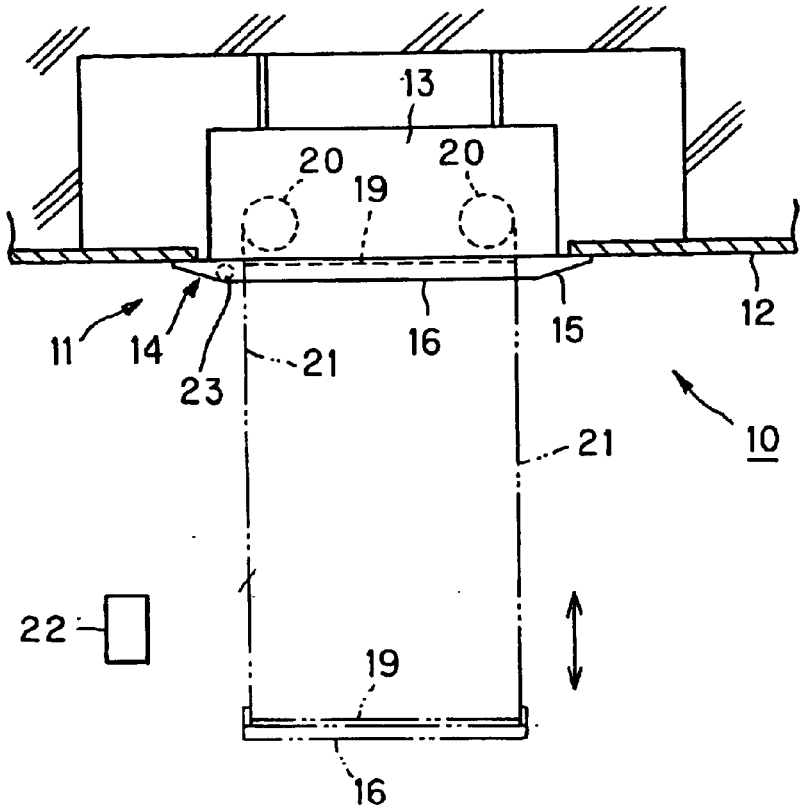
FIG. 4 is a side view showing an indoor unit and a wireless remote controller in an embodiment of an air conditioner according to the present invention.
Figure 5:
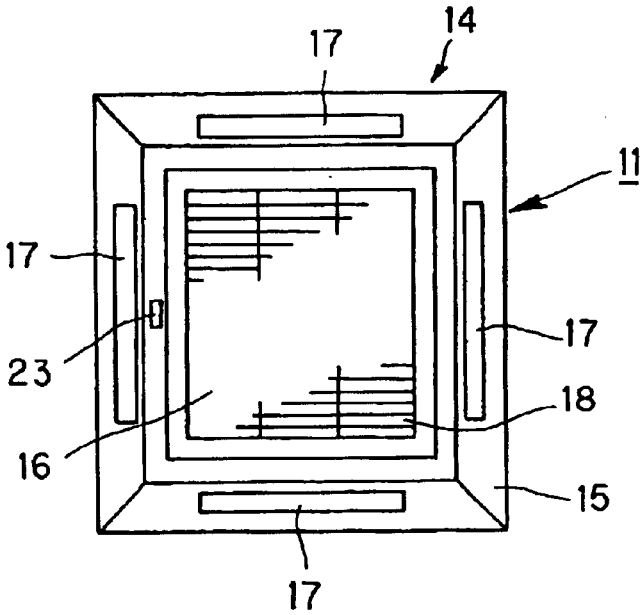
FIG. 5 is a front view showing the indoor unit shown in FIG. 4.

FIG. 4 is a side view showing an indoor unit and a wireless remote controller in an embodiment of an air conditioner according to the present invention, and FIG. 5 is a front view showing the indoor unit shown in FIG. 4. In the following embodiment, a ceiling embedded type air conditioner is used as the air conditioner, however, the present invention is not limited to the ceiling embedded type air conditioner, and it may be applied to various types of air conditioners and other apparatuses.

In the ceiling embedded type air conditioner 10 shown in FIGS. 4 and 5, an indoor unit 11 is set up while embedded in the ceiling 12. The indoor unit 11 has a main body 13 and a face panel 14. The main body 13 of the indoor unit 11 is generally fixed inside the ceiling 12 so as to be hidden, and the face panel 14 is mounted on the ceiling 12 while exposed from the ceiling 12.

An air blower and a heat exchanger (not shown) are accommodated in the main body 13 of the indoor unit 11. The face panel 14 has an outer frame body 15 having a rectangular frame structure, and a grille 16 disposed at the center open portion of the outer frame body 15. An air blowing port 17 is formed at each of the side portions of the outer frame body 15, and an air suction port 18 is formed in the grille 16. Further, a filter 19 is freely detachably mounted inside the grille 16 so as to confront the air suction port 18. Further, a receiver 23 for receiving a control signal from a wireless remote controller 22 is secured to the outer frame body 15.

While the air blower in the main body 13 of the indoor unit 11 is actuated, indoor air is sucked from the air suction port 18 of the grille 16 of the face panel 14 into the main body 13. The air thus sucked is heat-exchanged with the heat exchanger, and then blown out from the air blowing ports 17 of the outer frame body 15 of the face panel 14 into the room, whereby the air conditioning operation is efficiently carried out in every corner of the broad room.

In the indoor unit 11 thus constructed, pulleys 20 which are rotationally driven by a motor (not shown) are rotatably fixed to the outer frame body 15 of the face panel 14 or the main body 13 of the indoor unit 11, and cables 21 are wound around the pulleys 20. One end of each cable 21 is fixed to the grille 16 of the face panel 14, so that the pulleys 20 are rotated by driving the motor and the grille 16 is upwardly/downwardly moved relatively to the outer frame body 15 through the cables 21 and the pulleys 20. When the filter 19 is cleaned or exchanged, the grille 16 is downwardly moved by driving the motor.

In this case, the elevating operation of the grille 16 is set as one of specific operations which can be commonly carried out on the basis of a control signal from any wireless remote controller. That is, if the receiver 23 of the indoor unit 11 receives a control signal from any wireless remote controller 22, the elevating operation of the grille 16 is carried out. The other operations of the indoor unit 11, for example, the normal operations containing the fundamental operations such as the start/stop of the operation of the indoor unit 11, etc. are also carried out if the receiver 23 of the indoor unit 11 receives the respective control signals from the wireless remote controller 22.

In this embodiment, for example when a control signal is transmitted from the wireless remote controller 22 to the indoor unit 11 to make the indoor unit 11 carry out one of the normal operations, the indoor unit 11 concerned receives (accepts) the control signal from the wireless remote controller 22 to carry out the normal operation only when the address is coincident between the indoor unit 11 concerned and the wireless remote controller 22.

Figure 6:
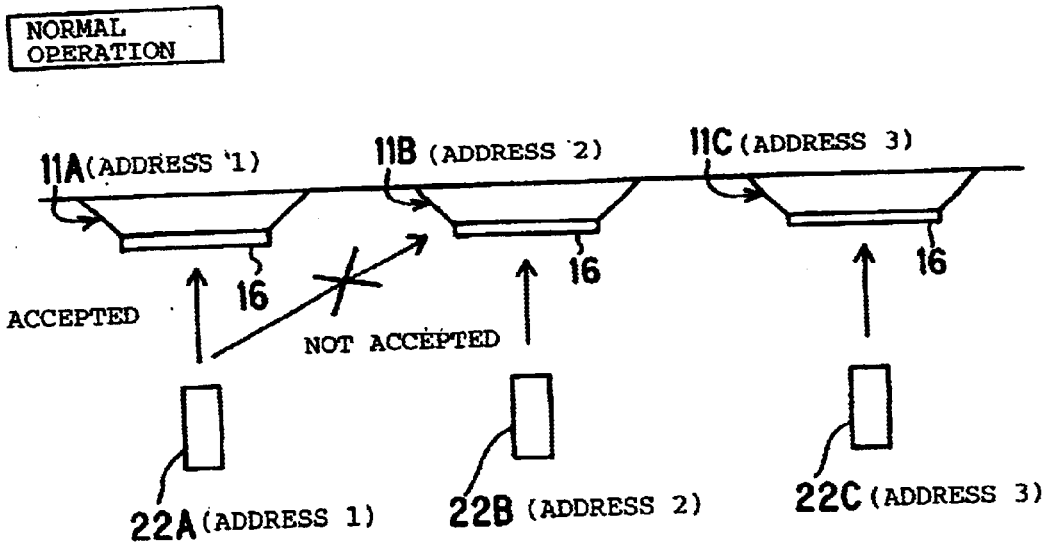
FIG. 6 shows a case where a normal operation is carried out in an air conditioner having plural indoor units 11A, 11B, 11C shown in FIG. 4 which are mounted in the same room and operated by using corresponding wireless remote controllers 22A, 22B, 22C respectively.

FIG. 6 shows a case where a normal operation is carried out in an air conditioner having plural indoor units 11A, 11B, 11C shown in FIG. 4 which are mounted in the same room and operated by using corresponding wireless remote controllers 22A, 22B, 22C respectively. In this air conditioner, with respect to the transmission/reception of the control signals for the normal operations, the same address is allocated to both the indoor unit 11A and the wireless remote controller 22A, the same address is allocated to both of the indoor unit 11B and the wireless remote controller 22B and the same address is allocated to both of the indoor unit 11C and the wireless remote controller 22C. Accordingly, for example, in order to make the indoor unit 11A carry out a normal operation, it is required to operate the wireless remote controller 22A having the same address as the indoor unit 11A and transmit the control signal for the normal operation concerned to the wireless remote controller 22 concerned.

That is, in this embodiment, the one-to-one relationship (i.e., address-connecting relationship) is established between the wireless remote controller and the indoor unit for the normal operations.

In this case, even when the control signal for the normal operation which is transmitted from the wireless remote controller 22A reaches the indoor unit 11B or 11C, the indoor unit 11B or 11C does not receive (accept) the control signal because the address of the wireless remote controller 22A is not coincident with the address of the indoor unit 11B or 11C.

On the other hand, in this embodiment, the address-free relationship (i.e., non-address connection) is established between the wireless remote controller and the indoor unit for the specific operations such as the grille elevating operation, etc. That is, any indoor unit can be controlled to carry out the specific operations on the basis of the control signal from any wireless remote controller. However, according to this embodiment, the power of the control signal for the specific operations is set to a value less than that for the normal operations. The degree of reduction of the power of the control signal is set such that when the control signal from any one of wireless remote controllers reaches a target indoor unit, the control signal does not reach the other indoor units. For example, the degree of reduction may be determined by the distance between the neighboring indoor units, the height to the ceiling on which the indoor units are mounted, etc.

Accordingly, the arrival distance of the control signal output from each wireless remote controller can be more shortened for the specific operations as compared with that for the normal operations by setting each wireless remote controller so that the control signal to be output therefrom is reduced in power for the specific operations as compared with that for the normal operations. The reduction in power of the control signal is equivalent to reduction in receiver sensitivity of each indoor unit.

Figure 1:
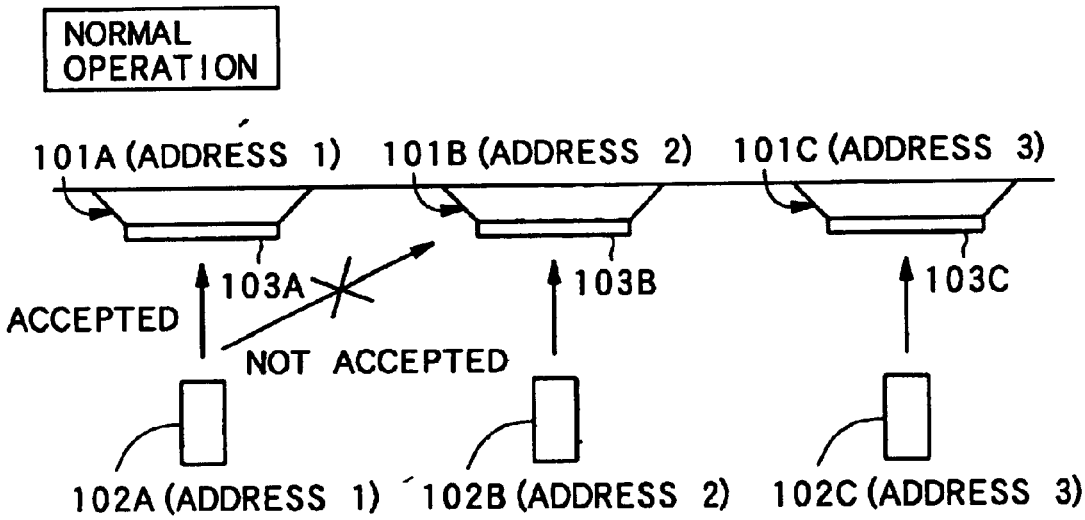
FIG. 1 shows an air conditioner having plural indoor units 101A, 101B, 101C which are mounted in the same room and operated by using corresponding wireless remote controllers 102A, 102B, 102C, respectively.
Figure 7:
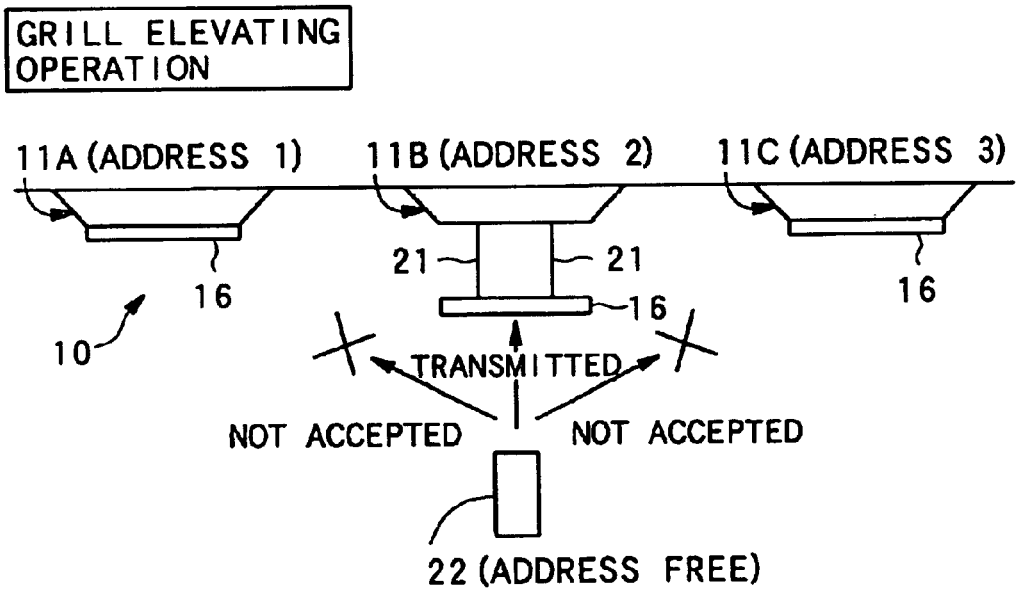
FIG. 7 shows a case where a control signal for a specific operation (grille elevating operation) is transmitted to the indoor unit 11B by using any wireless remote controller 22 to make the indoor unit 11B carry out the grille elevating operation while the wireless remote controller is near to the indoor unit 11B (for example, just below)
Figure 2:
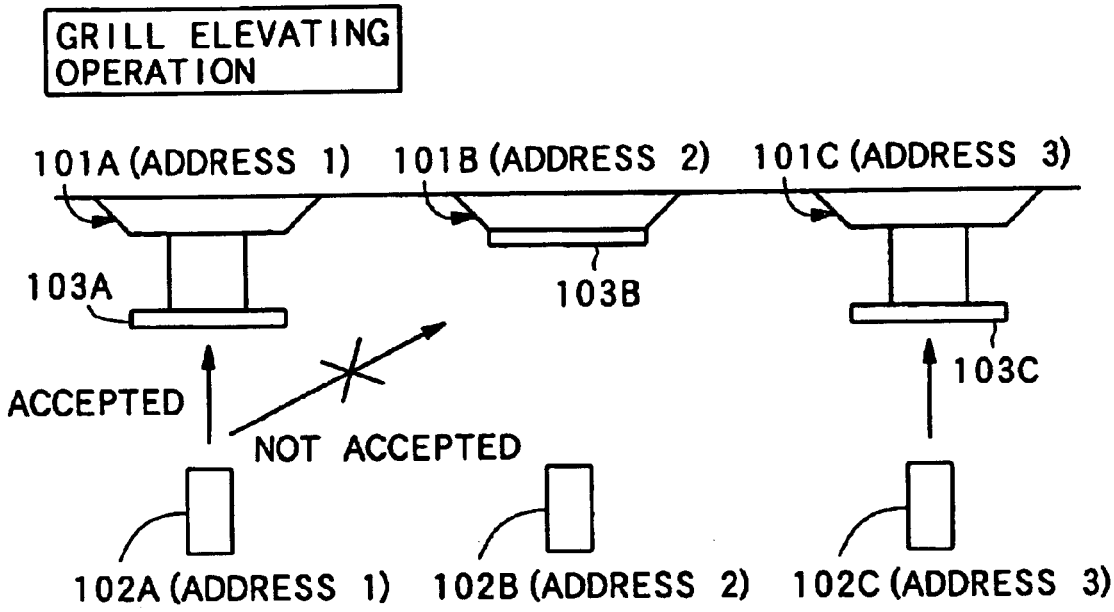
FIG. 2 shows a case where a grille elevating operation of the indoor unit 101A is carried out on the basis of a control signal from the wireless remote controller 101A.
Figure 3:
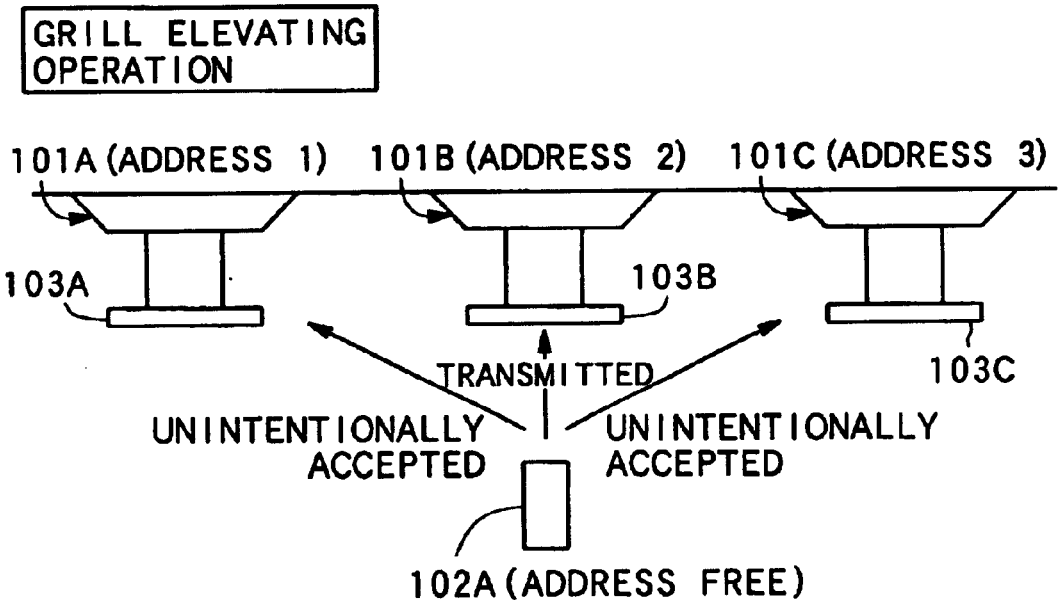
FIG. 3 shows a case where the address connecting relationship between each of the indoor units and each of the wireless remote controllers is released (i.e., the connecting relationship is set to an address-free state) only when the grille elevating operation is carried out on each of the indoor units.

For example, when a user transmits a control signal for a specific operation (grille elevating operation) to the indoor unit 11B by using any wireless remote controller 22 (any one of the wireless remote controllers 22A, 22B, 22C) to make the indoor unit 11B carry out the grille elevating operation while the user stands in the neighborhood of the indoor unit 11B (for example, just below) as shown in FIG. 7, all the indoor units 11A to 11C are allowed to accept the control signal from the wireless remote controller 22 because the address-free connection is established, however, only the indoor unit 11B can receive the control signal from the wireless remote controller 22 (neither the indoor unit 11A nor the indoor unit 11C can receive the control signal from the wireless remote controller 22) because the control signal output from the wireless remote controller 22 is reduced in power (i.e., the arrival distance of the control signal is reduced) and the distance between the wireless remote controller 22 and each of the indoor units 11A and 11C is longer than the distance between the wireless remote controller 22 and the indoor unit 11B.

As described above, with respect to the control signals for the specific operations (the grille elevating operation, etc.), the power of the control signal is reduced, that is, the receiver sensitivity of each indoor unit is reduced, so that the indoor units which are not expected to carry out the grille elevating operation (for example, indoor units 11A and 11C) can be prevented from unintentionally carry out the elevating operation of the respective grilles 16.

Figure 8:
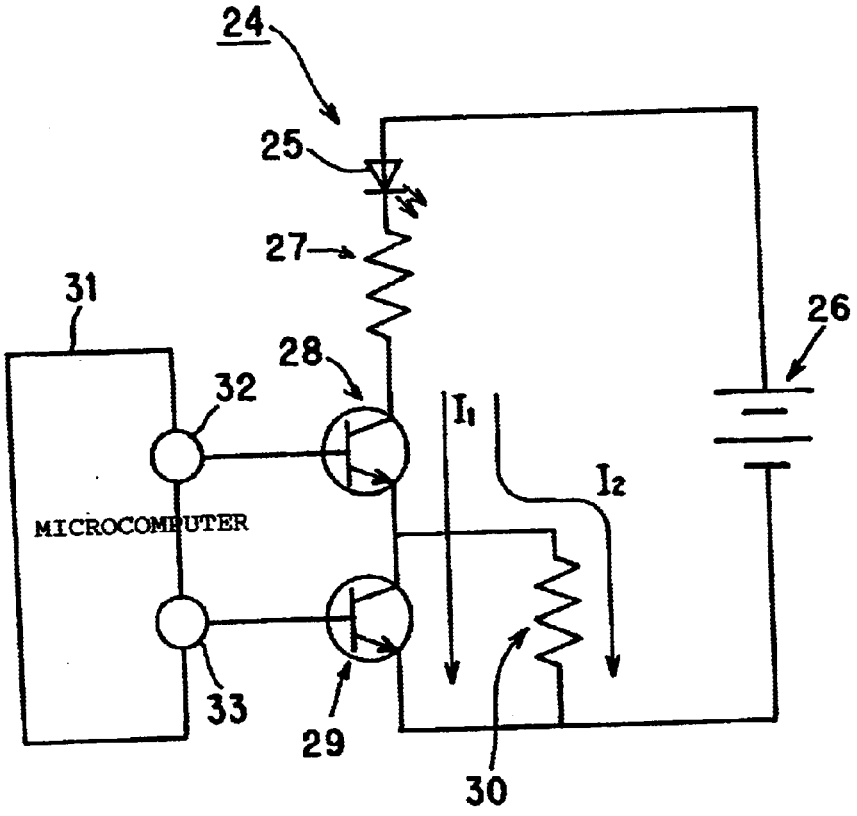
FIG. 8 shows the construction of a transmission circuit 24 of the wireless remote controller for reducing the power of the control signals for the specific operations containing the grille elevating operation.

Next, the construction of a transmission circuit 24 of the wireless remote controller for reducing the power of the control signals for the specific operations containing the grille elevating operation will be described with reference to FIG. 8.

The transmission circuit 24 of the wireless remote controller 22 has a transmission LED (light emission diode) 25 serving as transmission means for transmitting the control signal, and it basically controls (reduces) the power of the control signal by adjusting current flowing through the transmission LED 25. That is, when the control signal for the elevating operation of the grille 16 is transmitted from the wireless remote controller 22, the current flowing through the transmission LED 25 is reduced to a value less than when the control signal for the normal operation is transmitted from the wireless remote controller 22, thereby reducing the power of the control signal.

In this embodiment, an infrared-ray emitting diode is used as the transmission LED 25, and the current flowing through the transmission LED 25 is modulated to achieve a control signal. Specifically, the transmission circuit 25 has a power source 26, the transmission LED 25, a limit resistor 27 for the transmission LED, a signal output transistor 28 and a transmission power control transistor 29 which are connected to one another in series, and further has a transmission power limiting resistor 30 connected to the transmission power control transistor 29 in parallel.

The signal output transistor 28 is turned on/off on the basis of a signal output from a signal output port 32 of a microcomputer 31, and the transmission power control transistor 29 is turned on/off on the basis of a signal output from a transmission output control port 33 of the microcomputer 31.

When a control signal is transmitted from some wireless remote controller 22 to some indoor unit, the microcomputer 31 of the wireless remote controller 22 concerned outputs a signal from the signal output port 32 to the signal output transistor 28 to turn on the signal output transistor 28, so that current flows through the transmission LED 25, the limit resistor 27 for the transmission LED and the signal output transistor 28 by the power source 26.

In this case, if the control signal to be transmitted from the wireless remote controller 22 is used to carry out a normal operation other than the grille elevating operation, the microcomputer 31 outputs a signal from the transmission output control port 33 to the transmission output control transistor 29 to turn on the transmission output control transistor 29. At this time, the current flowing through the signal output transistor 28 also flows through the transmission output control transistor 29 and then returns to the power source 26.

In this case, the current flowing through the transmission LED 25 is set to $I_1$ and the power of the control signal transmitted from the transmission LED 25 is kept to a predetermined level. This level is set to a high level and thus the receiver sensitivity of each indoor unit 11 is apparently set to an excellent level.

On the other hand, if the control signal to be transmitted from the wireless remote controller 22 is used to carry out the grille elevating operation, the microcomputer 31 outputs a signal from the transmission output port 32 to the signal output transistor 28 to turn on the signal output transistor 28, but outputs no signal from the transmission output control port 33 to the transmission output control transistor 29 to turn off the transmission output control transistor 29. Therefore, the current flowing through the transmission LED 25, the limit resistor 27 for the transmission LED and the signal output transistor 28 does not flow through the transmission output control transistor 29, but flows through the transmission output limit resistor 30 and then returns to the power source 26.

In this case, the current flowing through the transmission LED 25 is set to $I_2$ which is smaller than $I_1$ ($I_2<I_1$) because some voltage drop occurs through the transmission output limiting resistor 30. Accordingly, the power of the control signal transmitted from the transmission LED 25 is reduced to a value lower than that of the control signal when the normal operation is carried out. Therefore, the receiver sensitivity of each indoor unit is apparently reduced to a level less than that of each indoor unit when the normal operation is carried out. In this case, the power of the control signal is lowered to the extent that the indoor unit 11 located at the nearest position to the wireless remote controller 22 can accept the control signal from the wireless remote controller 22, but the other indoor units 11 cannot accept the control signal.

According to the above embodiment, the following effects (1) and (2) can be achieved.

(1) Only when the control signal for elevating the grille 16 is transmitted from a wireless remote controller 22 to the indoor unit 11A 11B, 11C, the power of the control signal from the wireless remote controller 22 concerned is lowered to shorten the arrival distance of the control signal, whereby the receiver sensitivity of the indoor units 11A, 11B, 11C are apparently lowered. Therefore, if the control signal for the grille elevating operation is transmitted from the wireless remote controller 22 while the wireless remote controller 22 faces an indoor unit 11 (for example, the indoor unit 11B in FIG. 7) which is required to elevate (upwardly or downwardly move) the grille 16 thereof, the grille 16 of the indoor unit 11B is upwardly/downwardly moved, however, the grilles 16 of the other indoor units 11A and 11C which are not required to elevate their grilles 16 are prevented from being unintentionally moved upwardly or downwardly because all the indoor units 11A to 11C are apparently lowered in receiver sensitivity.

Accordingly, as compared with the case where the respective addresses are allocated to the wireless remote controllers 22A, 22B, 22C and the indoor units 11A, 11B, 11C and only when the addresses are coincident with each other, the indoor unit 11A, 11B, 11C accepts the control signal from the wireless remote controller 22A, 22B, 22C to elevate the grille 16 and the case where the control signal for elevating the grille 16 is successively transmitted from the wireless remote controller 22 to the indoor units 11A, 11B, 11C while the setting of the address in the simple wireless remote controller 22 is successively changed, the operationality of the indoor units 11A, 11B, 11C and the wireless remote controllers can be more enhanced with respect to the grille elevating operation using the wireless remote controller 22 (wireless remote controllers 22A, 22B, 22C).

(2) Only when the control signal for elevating the grilles 16 of the indoor units 11A to 11C is transmitted from the wireless remote controller 22 (wireless remote controllers 22A, 22B, 22C), the power of the control signal is lowered, and thus the receiver sensitivity of the indoor units 11A, 11B, 11C is apparently lowered. Therefore, not only the operationality for the grille elevating operation using the wireless remote controller 22 (wireless remote controllers 22A, 22B, 22C) can be enhanced like the effect (1), but also the indoor unit 11 (for example, the indoor units 11A and 11C) which are not expected to carry out the elevating operation of their grilles 16 can be prevented from elevating their grilles 16, so that the risk due to the upward/downward movement of the grille 16 can be surely prevented.

The present invention is not limited to the above embodiment, and various modifications may be made to the embodiment. For example, in the above embodiment, the transmission means transmits the control signal by using infrared rays. However, it may transmit the control signal by using electronic waves or the like.

Further, in the above embodiment, the control signal which is transmitted from the wireless remote controller 22 (transmission LED 25) to carry out the specific operation is a control signal for elevating (upwardly/downwardly moving) the grille 16. However, the control signal of the present invention is not limited to the control signal for the grille elevating operation, and may contain various control signals for other operations which are needed to be individually executed every indoor unit, such as a control signal for changing a flap angle, a control signal for changing the set temperature, a control signal for setting a timer, etc.

Still further, in the above embodiment, the indoor unit 11 of the air conditioner 10 is used as a control target unit to be controlled by the wireless remote controller 22. However, the present invention may be applied to a case where the illumination of illuminating equipment, the opening/closing amount of a curtain, a shutter or the like, or the like is adjusted by using the wireless remote controller 22.

Still further, in the above embodiment, only when the specific operation is carried out, the power of the control signal from the wireless remote controller is reduced to make the power-reduced control signal reach only an indoor unit which the wireless remote controller faces. In place of or in combination with the construction of the above wireless remote controller, the wireless remote controller may be modified so that the power of the control signal from the wireless remote controller is increased to make the power-increased control signal to all or plural indoor units around an indoor unit which the wireless remote controller faces. In this case, for example when it is required to make some neighboring indoor units execute the same operation, the control signal from the wireless remote controller can reach these neighboring indoor units and thus these indoor units can execute the same operation at the same time.

According to the present invention, the operationality of plural control target units by the wireless remote controller can be enhanced. Further, control target units which are not required to carry out a specific operation such as the grille elevating operation can be prevented from unintentionally carry out the operation on the basis of a control signal transmitted from a wireless remote controller to a control target unit which is required to carry out the operation. Therefore, the risk that an unexpected control target unit is unintentionally driven by a control signal which is not addressed to the unexpected control target unit.

What is claimed is:

1. A wireless remote controller for transmitting a control signal to control target equipment for controlling operation of the control target equipment, comprising:

a control signal generator for generating the control signal in accordance with an operation to be executed by the control target equipment and transmitting the control signal thus generated to the control target equipment; and a controller for varying the power of the control signal to be generated by said control signal generator in accordance with an operation which is expected to be carried out by the control target equipment wherein the power of the control signal to be transmitted to the control target equipment is varied in accordance with an operation which is expected to be executed by the control target equipment, the wireless remote controller and the control target equipment are associated with each other in an address-connected relationship, and only when a control signal for causing the control target equipment to perform a specific operation other than normal operations is transmitted to the control target equipment, the address-connected relationship is set to an address-free state and the power of the control signal is reduced.

2. The wireless remote controller as claimed in claim 1, wherein the power of the control signal to be transmitted to the control target equipment is lowered only when the control signal to be transmitted to the control target equipment is a specific control signal for causing the control target equipment to perform the specific operation other than normal operations.

3. The wireless remote controller as claimed in claim 1, wherein the power of the control signal is lowered.

4. The wireless remote controller as claimed in claim 3, wherein the control target equipment comprises at least two control target units, and the power of the control signal is lowered so that the control signal only reaches one of the control target units which is expected to carry out the specific operation.

5. The wireless remote controller as claimed in claim 1, wherein said control signal generator generates the control signal by making current flow therethrough, and the output power of the control signal is varied by varying the intensity of the current flowing said control signal generator.

6. The wireless remote controller as claimed in claim 5, wherein said control signal generator includes a power source, a transmission LED, a first resistor, a first transistor and a second transistor connected in series, and further includes a second resistor connected in parallel to said second transistor and wherein the power of the control signal is varied by turning on/off said second transistor.

7. The wireless remote controller as claimed in claim 6, wherein said controller outputs a turn-on/off signal to the base of each of said first and second transistors to thereby turn on/off said first and second transistors.

8. An air conditioner having at least two indoor units and at least one wireless remote controller, each of said indoor units being controlled on the basis of a control signal from said wireless remote controller, wherein power of the control signal for transmittal to one of said indoor units is varied in accordance with an operation which is expected to be executed by said indoor unit, the wireless remote controller and the control target equipment are associated with each other in an address-connected relationship, and only when a control signal for causing the control target equipment to perform a specific operation other than normal operations is transmitted to the control target equipment, the address-connected relationship is set to an address-free state and the power of the control signal is reduced.

9. The air conditioner as claimed in claim 8, wherein the power of the control signal to be transmitted to each of said indoor units is lowered only when the control signal to be transmitted to said indoor unit is a specific control signal for making said indoor unit carry out a specific operation other than normal operations.

10. The air conditioner as claimed in claim 9, wherein the specific operation is an operation of upwardly and downwardly moving a grille of each indoor unit.

11. The air conditioner as claimed in claim 8, wherein the power of the control signal is lowered.

12. The air conditioner as claimed in claim 11, wherein the power of the control signal is lowered so that the control signal only reaches one of said indoor units which is expected to carry out the specific operation.

13. The air conditioner as claimed in claim 8, wherein said wireless remote controller comprises a control signal generator for generating the control signal in accordance with an operation to be executed by each indoor unit and transmitting the control signal thus generated to each indoor unit; and a controller for varying the power of the control signal to be generated by said control signal generator in accordance with an operation which is expected to be carried out by one of said indoor units.

14. A method for transmitting a control signal from at least one wireless remote controller to each of a plurality of control target units and for controlling operation of one or more of said control target units based on the transmitted control signal, comprising the steps of:

associating the wireless remote controller and each of the control target units in an address connected relationship, and varying the power of the control signal to be transmitted to a desired one of the control target units only when the control signal to be transmitted to the control target unit concerned is a specific control signal for causing the control target unit concerned to perform a specific operation other than normal operations so that the control signal reaches only a desired one of the control target units, wherein the address-connected relationship is set to an address-free state, and power of the control signal is reduced.

* * * * *